United States Patent [19]

Bridgman

[11] 4,186,758

[45] Feb. 5, 1980

[54] VEHICLE CANOPY

[76] Inventor: Harold Bridgman, 5317 S. 188th Ct., Aloha, Oreg. 97005

[21] Appl. No.: 916,792

[22] Filed: Jun. 16, 1978

[51] Int. Cl.[2] ..... E04F 10/06

[52] U.S. Cl. ..... 135/5 AT; 135/1 A

[58] Field of Search ..... 135/5 AT, 5 A, 7.1 A, 135/1 A; 248/226.4

[56] References Cited

U.S. PATENT DOCUMENTS

| | | | |
|---|---|---|---|
| 1,225,567 | 5/1917 | Bongiovanni | 248/226.4 |
| 1,733,007 | 10/1929 | Dahl | 135/5 A |
| 2,836,223 | 5/1958 | Kent | 248/226.4 |
| 2,996,570 | 8/1961 | Wilson | 248/226.4 |
| 3,136,289 | 6/1964 | Johnson | 248/226.4 |
| 3,902,931 | 9/1975 | Dancinger | 248/226.4 |

*Primary Examiner*—Reinaldo P. Machado
*Attorney, Agent, or Firm*—James D. Givnan, Jr.

[57] ABSTRACT

An attachment for securement to the rain gutter of a van or like vehicle to permit the convenient setting up of a canopy supporting frame. The attachment is of C-shaped configuration having a movable plate member oppositely engageable with the gutter. A retainer of the attachment slidably receives a frame member to support same above the vehicle side.

3 Claims, 4 Drawing Figures

VEHICLE CANOPY

BACKGROUND OF THE INVENTION

The present invention relates generally to canopy framework structures and particularly to such a structure adapted for attachment to a vehicle.

Highly popular for recreational purposes are light trucks termed "vans" which are outfitted for camping and touring purposes. Presently available are canopy structures which are at least partially supported by the vehicle to provide the user a shaded, outdoor area. Most commonly the canopy is roller mounted to permit the same to be compactly stored either on the van or in a detachable holder.

A detraction from known canopy arrangements is that a number of same require a permanent attachment of one sort or another be mounted to the van detracting from van appearance. Secondly, the cost of known canopies is higher than a large segment of the public is willing to pay for such an accessory. Thirdly, some canopy arrangements are cumbersome taking up space in the cargo area of the van when stored.

SUMMARY OF THE PRESENT INVENTION

The present invention is embodied in a canopy supporting attachment readily affixable to the camper rain gutter in a removable manner.

The attachment permits a canopy framework to be partially supported by the vehicle rain gutter at a desirable height providing adequate canopy headroom. The attachment includes a positionable member which seats within the camper gutter and serves, with a cooperating member, to grip same and support a canopy framemember in upwardly spaced relationship above the side of the van. Remaining frame members extend outwardly from the van and interconnect with one another and with ground engaging supports completing the canopy frame. Various canvas or plastic coverings may be used with the framework to provide the desired protection from the elements.

Important objectives of the present invention include the provision of an attachment for temporary engagement with the side of a vehicle such as a van, camper, motor home, trailer or the like, which permits the convenient installation and support of a canopy frame member; the provision of an attachment adapted for secure engagement with the gutter of a vehicle without marring same; the provision of an attachment having a circular retainer shaped to retain a frame member; the provision of an attachment for installation and removal without the aid of tools.

DETAILED DESCRIPTION OF THE PREFERRED EMBODIMENT

Figure 1:
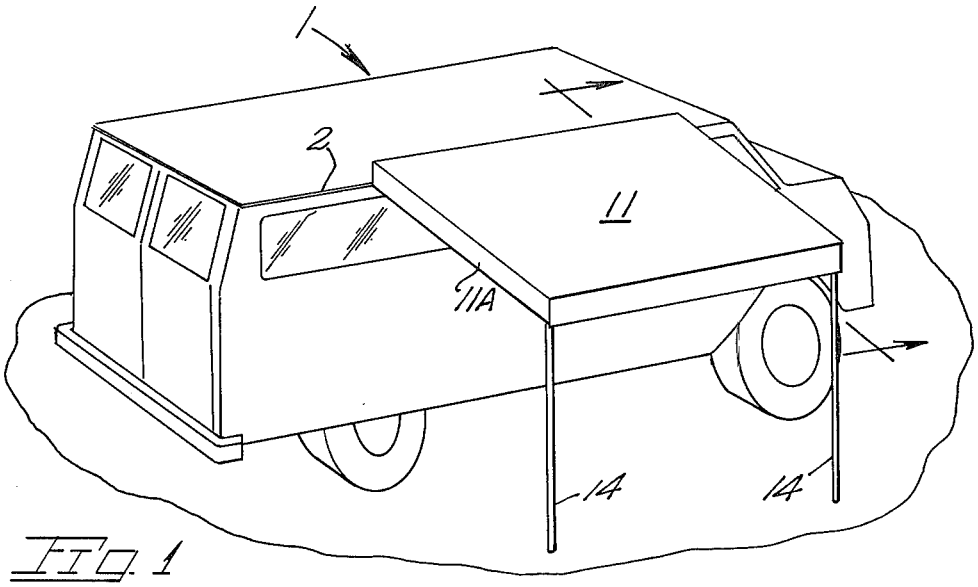
FIG. 1 is a perspective view of a recreational vehicle with a canopy attached.

In the accompanying drawing, the reference numeral 1 indicates generally a recreational vehicle which may be a van as shown or other such vehicle.

Figure 2:
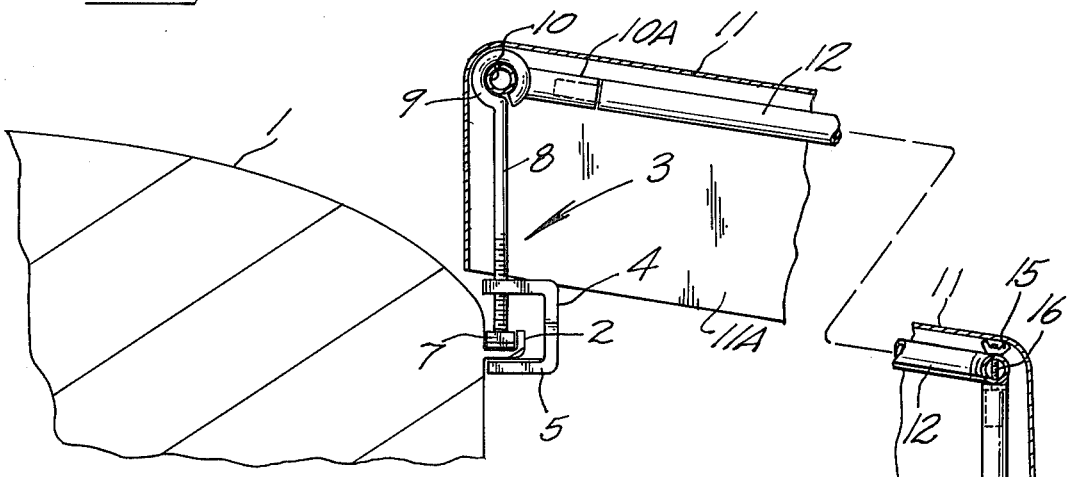
FIG. 2 is a sectional elevational view taken along line 2—2 of FIG. 1 showing details of the present canopy supporting attachment.
Figure 4:
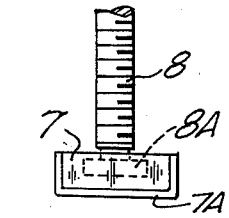
FIG. 4 is an end elevational view of a portion of said attachment showing details of construction.
Figure 3:
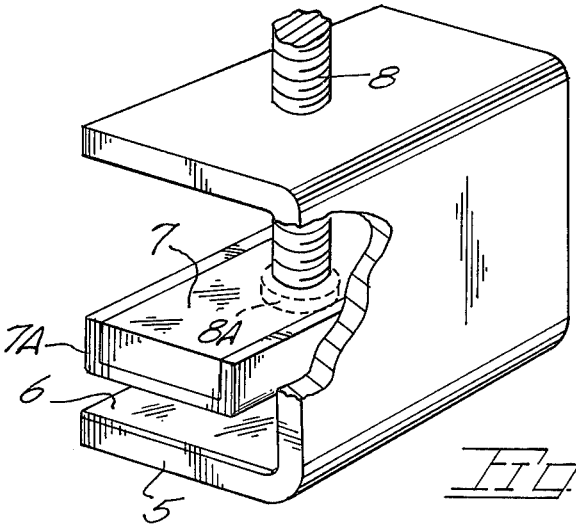
FIG. 3 is an enlarged perspective view of the lower end of said attachment.

With attention to FIG. 2, a rain gutter is indicated at 2 which is typically formed integral with the vehicle body with such gutters extending along the uppermost sides of the vehicle and the upper rear end thereof. The gutters are of angular configuration in section and may have somewhat curved horizontal and upright components as viewed in section.

The present attachment is indicated generally at 3 and includes a C-shaped member indicated at 4 which includes a lowermost flange 5 engageable with the underside of gutter 2 when operatively disposed thereon. Preferably C-shaped member 4 is provided with a resilient member at 6 to prevent marring of the vehicle finish. A plate 7 is rotatably carried by a threaded shaft end 8A of a flange engaged threaded member 8 terminating upwardly in a frame receiving retainer 9 which may be of circular configuration having an inside diameter adequate to slidably receive a tubular canopy supporting member indicated at 10. Member 10 is shown as one member of a rectangular tubular frame which serves to support a foldable canopy indicated at 11 having downwardly depending sides 11A which encompass the aforementioned frame. To facilitate attachment of frame 10 by means of an attachment 3, the frame 10 is terminated at 10A at its fore and aft ends and thereat receives, in a suitably locked manner, frame side members indicated at 12. For the sake of convenience said frame members may be interconnected in a suitable telescopic, lockable manner permitting compact stowage and also enabling adjustment of the frame to a desired size. Plate 7 is elongate and may be provided with a resilient covering 7A for protection of the gutter.

Indicated at 14 are legs or support members having ground supported lower ends which terminate upwardly in removable engagement with the canopy frame members. Such removable engagement may be economically achieved by utilizing a threaded stud 16 carried by and extending upwardly from support 14, through the frame member 12 to receive a wing nut at 15. Support members 14 may also be of a telescopic and lockable nature including separable segments to facilitate storage of same as well as adjustment of the canopy pitch.

In use, the attachments 3 are engaged with the rain gutter 2 at spaced apart segments therealong with the upper ends thereof disposed so as to receive an inserted frame member 10. Thereafter the side members 12 are attached to frame 10 whereupon the completed frame may be elevated into position by attachment of the supports 14. Accordingly upon placement of the canopy 11 on the completed frame the canopy is ready for use. Other fabric canopy components may be added to provide privacy or additional protection from the elements.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. A vehicle canopy attachment for disposition outwardly from one side of the vehicle, said canopy comprising, tubular canopy supporting members, leg members in supporting engagement at their upper ends with at least one of said canopy supporting members and in ground contact at their lower ends, C-shaped members each having a flange adapted for abutment with a segment of the vehicle rain gutter, an upright threaded member in adjustable engagement with each C-shaped member, an elongate plate rotatably mounted at one end of said threaded member and adapted for insertion by advancement of said threaded member into a segment of rain gutter and into abutting engagement therewith whereby said flange of each C-shaped member and said plate of each threaded member are securely and oppositely abutted against a length of rain gutter, each threaded member terminating at its remaining end in a circular retainer for disposition above the rain gutter and within which one of said canopy supporting members is insertably engageable, and a canopy for supported placement over said tubular members.

2. The vehicle attached canopy claimed in claim 1 wherein said canopy has at least one depending side of a vertical length less than the length of said upright threaded members.

3. The vehicle attached canopy claimed in claim 1 wherein said flange and said plate each include a resilient component to prevent marring of the vehicle rain gutter.

* * * * *